US006340310B2

(12) United States Patent
Henrici et al.

(10) Patent No.: US 6,340,310 B2
(45) Date of Patent: Jan. 22, 2002

(54) LAMP HOLDER

(75) Inventors: Dieter Henrici, Arnsberg; Manuel Rodrigues, Wickede/Ruhr, both of (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 09/731,252

(22) Filed: Dec. 6, 2000

(30) Foreign Application Priority Data

Dec. 7, 1999 (DE) ..... 199 58 841

(51) Int. Cl.[7] ..... H01R 13/625; H01R 4/50; H01R 13/627

(52) U.S. Cl. ..... 439/346; 439/352; 439/360

(58) Field of Search ..... 439/346, 356, 439/360, 366, 352

(56) References Cited

U.S. PATENT DOCUMENTS 3,656,183 A * 4/1972 Walterscheid ..... 439/73
4,152,041 A * 5/1979 Hollyday et al. ..... 439/188
4,596,433 A * 6/1986 Oesterheld et al. ..... 439/206
5,078,625 A * 1/1992 Anzai ..... 439/699
5,207,600 A * 5/1993 Dulmen ..... 439/682
5,547,402 A * 8/1996 Ogawa ..... 439/699.2
5,971,814 A * 10/1999 Boyd et al. ..... 439/699.2

FOREIGN PATENT DOCUMENTS

DE 76 01 110 U1 6/1976
DE 76 32 236 U1 2/1977

* cited by examiner

*Primary Examiner*—Paula Bradley
*Assistant Examiner*—Edwin A. León
(74) *Attorney, Agent, or Firm*—Herbert Dubno

(57) ABSTRACT

A lamp holder has a contact spring which, instead of being bent into a U-shape and having its barb on the bracing shank opposite the retaining shank, has a bracing barb or lug bent out of the retaining shank itself and engageable as an indexing member behind a projection formed on the lamp housing.

13 Claims, 6 Drawing Sheets

LAMP HOLDER

FIELD OF THE INVENTION

Our present invention relates to a lamp holder and, more particularly, to a lamp holder specific to pin-based lamps, for example, compact fluorescent lamps with G 23, G 24 or 2G 11 type sockets and halogen lamps with G 12 or PG 12 type sockets and generally comprised of a housing of electrically insulating material having usually two contact springs whose bent shoulders engage detent recesses or projections on the lamp base so as to provide sufficient retaining force on the base and make an electrical connection with the pin thereof.

BACKGROUND OF THE INVENTION

Lamp holders of this type serve on the one hand to make electrical connection between the conductors within the lamp and the electric current network supplying the lamp and, on the other hand, to retain the lamp mechanically in the holder. The lamps with which the invention is concerned are primarily those lamps which have detent formations in the lamp base, behind which the shoulder of the contact spring can engage, and contacts which are likewise engageable with the contact spring so as to provide the electrical connections.

Lamp holders of this type must have at least one contact spring for retaining the lamp base in position or to secure the lamp base against falling out of the lamp.

In a conventional lamp holder for the aforedescribed lamps and which represents the starting point for the present invention and over which the invention is an improvement, the contact spring is bent from a flat strip and has a hairpin shape with two shanks connected together through approximately a 180° bend. The U-shaped member thus has a bight between a shank formed with the shoulder and constituting the base-retaining member and contact shank, and a bracing shank which resiliently engages a wall of the holder housing and urges the first-mentioned shank toward the lamp base.

This second shank, which may be referred to as a bracing shank, has an indexing formation formed therefrom and projecting outwardly to engage a formation on the housing behind which this indexing formation can lock. The contact spring is inserted with its U-shaped body into a pocket in the lamp housing in the same direction as the lamp is inserted and, when that contact spring is fully inserted, its detent engages behind the formation of the housing in a snap fit, thereby retaining the contact spring against tractive forces tending to pull it out of the housing. The detent can lie against the wall of the pocket inwardly of the projection and the shoulder on the lamp-retaining shank projects into the path of the lamp base to come into engagement with the latter, whereby that shoulder can be cammed outwardly by the base and spring behind the seat formed in the base for engagement thereof in the lamp holder.

Usually the lamp holder has two such pockets, each with a respective contact spring and the contact springs are disposed opposite one another to engage opposite sides of the lamp base. Of course it is also possible to use a single contact spring to retain the lamp base against a fixed abutment on the housing opposite that contact spring.

Lamp holders of the aforedescribed type have been found to be highly successful in practice.

However, it is always desirable to reduce the amount of material in such devices, to limit the work which goes into producing the unit and, of course, to limit the cost while maintaining the effectiveness of the lamp holder.

OBJECTS OF THE INVENTION

It is therefore the principal object of the present invention to provide an improved lamp holder, especially for the types of lamps mentioned earlier, whereby the contact spring can be simplified without reduction in its effectiveness and thus a considerable saving of material can be accomplished especially in the case of mass-produced lamp holders.

Another object of the invention is to provide an improved lamp holder which utilizes a simplified contact spring and which is therefore more desirable than earlier lamp holders for the same types of lamps.

Another object of this invention is to optimize the utilization of material in the fabrication of lamp holders.

SUMMARY OF THE INVENTION

These objects and others which will become apparent hereinafter are attained in a lamp holder configured to receive a base and, for example, conpact fluorescent lamps of types G 23, G 24 or 2G 11 or have halogen lamps of types G 12 or PG 12 and wherein the insulated housing receives at least one contact spring for retaining the lamp base and mechanically retaining the lamp base in the lamp shoulder housing or socket and wherein the shank of the contact spring provided with the shoulder is free from the aforementioned bight and is not connected to another shank bent from the contact spring via a bight, but rather the bracing shank is formed out of the shoulder forming the lamp-retaining shank and is provided directly with the indexing formation or lug. In other words the lamp-retaining shank has a free end and is generally flat except for a lug which is bent out of that shank between the end thereof and braces against the housing while directly forming the indexing lug, the shoulder and the lug projecting from opposite sides of the same shank.

More particularly, the lamp holder comprises:

- a housing composed of electrically insulating material formed with a cavity opening along a side of the housing; and
- at least one electrically conductive contact spring received in the housing for engagement with the base of the lamp for mechanical retention of the base and electrical connection therewith, the contact spring being formed from a planar metal strip with a shank having a free end lodged in the housing, a bend at an opposite end of the shank and forming a shoulder engageable with and biased against the base for retaining the base in the housing against tension tending to withdraw the base from the housing, and a barb formed from the shank between the free end and the shoulder and bent from the shank away from a direction in which the shoulder is bent from the shank for bracing against the housing, the barb being formed as a detent lug engaging behind a projection on the housing for retaining the contact spring in the housing.

The invention eliminates the need for a separate bracing shank bent from the retaining shank through 180° and the function of that bracing shank is taken over completely by the lug which is bent out of the retaining shank between the ends thereof, this lug serving simultaneously as the indexing element for locking the contact spring in its pocket in the housing. The result is a significant saving of material for the contact springs without requiring a redimensioning of the housing or the balance of the lamp holder. In excess of one-half of the length of the sheet metal strip required for each contact spring is no longer necessary.

It has been found to be advantageous to cut out the barb or lug from the retaining shank so that it has a free end turned toward the end of the contact spring provided with the shoulder.

The contact spring itself can have a generally flat or planar shank from which the indexing lug or barb can be cut out and bent and which can be provided with the shoulder. The formation of the barb can be such that it itself is different from the lug formed on the bracing shank of the prior art contact spring bent through 180° with respect to the retaining shank in that its free end is turned toward the shoulder rather than toward the free end of the metal strip opposite the shoulder. The barb can be elongated and connected to the retaining shank at an end of the barb turned away from the end of the contact spring provided with the shoulder and the barb can then have a straight portion including an acute angle with the shank and another portion at an obtuse angle of the straight portion and substantially parallel to the shank with the contact spring. Lodged in the housing this other portion can lie flat against the housing and can have an edge engaging the projection for locking the contact spring in the housing. The retaining shank has a portion extending from a junction of the barb with the shank to an end thereof and received in a slit in the housing.

With this shape and construction, the requisite bracing and locking function can be achieved without the bent shank extending the retaining shank.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
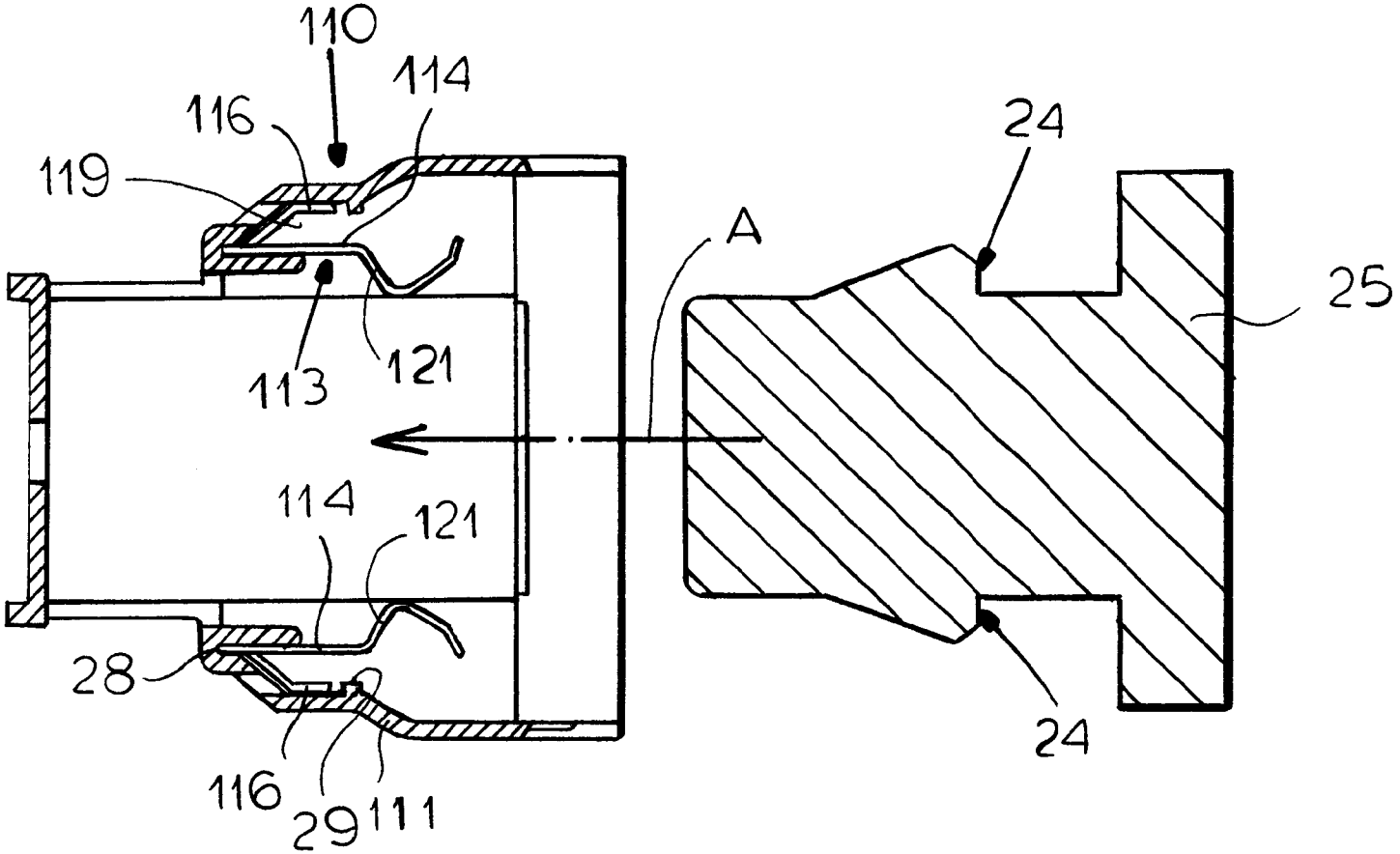
FIG. 1 is a longitudinal section of a lamp holder according to the invention and illustrating a base diagrammatically of a lamp which can be inserted therein.

Referring first to FIGS. 9–12 which serve to illustrate the prior art, it can be seen that the lamp holder 10 can comprise a housing 11 on diametrically opposite sides of which, insertion pockets 12 can be provided which are open toward the 10 base of a lamp to be inserted therein and each of which receives a respective contact spring 13 capable of locking into the pocket.

Each contact spring has a retaining shank 14 and a bracing shank 16 connected to the retaining shank by a bight 15, the two shanks forming a bend at the bight through about 180°. The outer surface 16*a* of the bracing shank 16 presses close to its free end 16*b* on an inner surface 11*a* of the housing 11. In addition, the bracing shank 16 is formed close to its free end with a U-shaped cut out 17 (FIG. 12) from which a tongue-like barb 18 can be bent outwardly. The barb 18, once the contact spring has been inserted into the pocket, can engage in an opening 19 in the housing so that its free end 18*a* can lock against a retaining surface 20 of the housing. The retaining surface 20 may be formed on an inward projection of the housing.

The contact spring 13 is then locked in the housing in the cutout 19. By pressing inwardly against the bracing shank 16, the barb 18 can be released so that the contact spring can be pulled out but aside from that type of release, the spring 13 cannot be pulled out from its seat in the housing and is securely retained there.

The retaining shank 14 of the contact spring has an outwardly bent shoulder 21 to engage a base 25 of a lamp. The retaining shank can be resiliently bent as indicated by the arrows 22 at the axes defined by the bights 15 when the lamp base 25 is snapped into the lamp holder 10 as will be described in connection with FIGS. 1–3. In the final fully inserted position of the lamp base, the shoulders snap behind the surfaces of the lamp base which are to be retained by these shoulders and simultaneously make electrical contact with the lamp.

From the foregoing it will be apparent that the contact spring 13 has a number of functional elements including the shoulders 21 on the shanks 14 which grip the base 25 of the lamp and the shank 16 which braces the shank 14 inwardly by itself resting against an outer part of the housing. The U-shaped bight 15 serves to interconnect the bracing shank 16 and the retaining shank 14 and the barb 18 is here on the bracing shank. The contact spring 13 is formed from a planar sheet metal strip 23 of a length L (FIG. 12) and the free edge 18a of the barb 18 is turned toward the end of the bracing shank and hence the end 23*b* which is opposite the end 23*a* formed with the shoulder 21.

Figure 2:
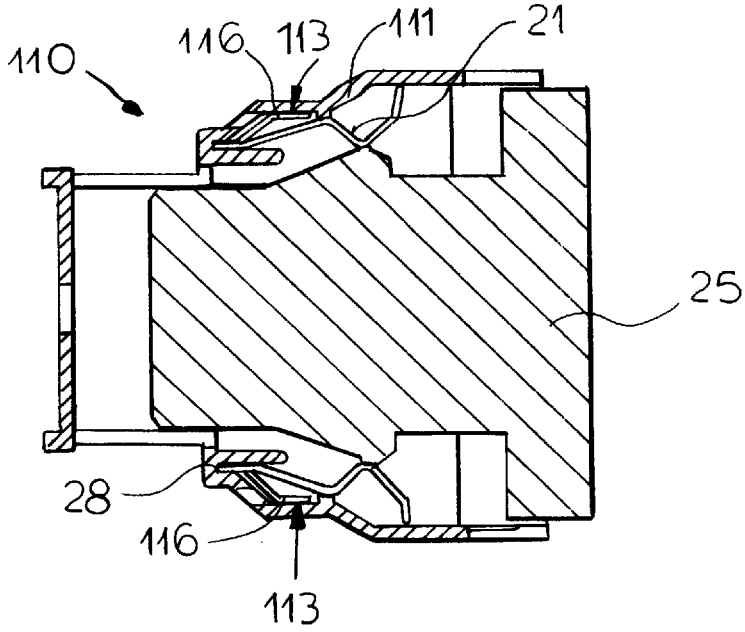
FIG. 2 is a section similar to FIG. 1 showing partial insertion of the lamp base.
Figure 3:
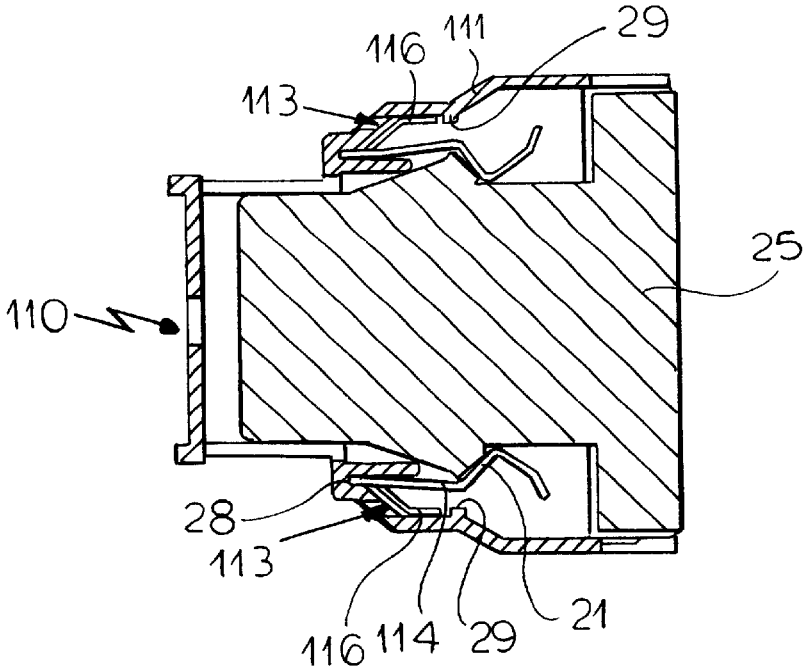
FIG. 3 is another section similar to FIG. 1 showing the full insertion of the lamp base.
Figure 4:
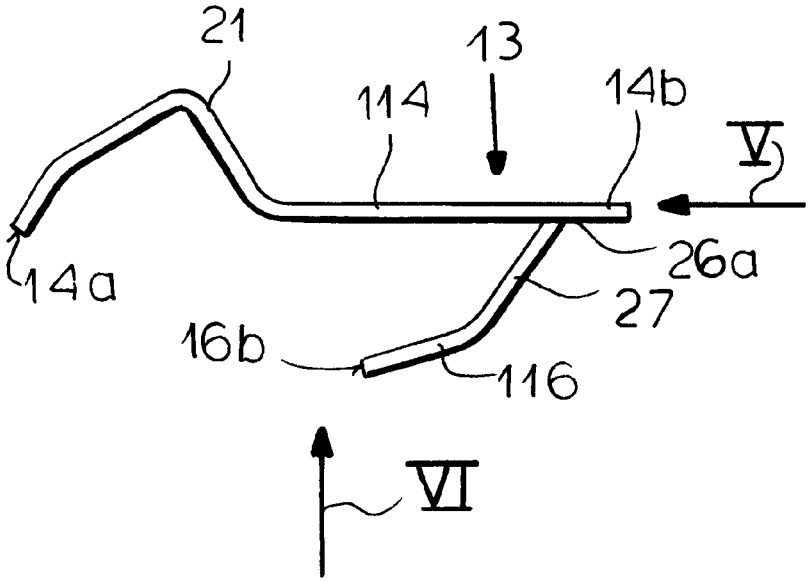
FIG. 4 is a side elevational view, greatly enlarged in scale of a contact spring according to the invention.
Figure 7:
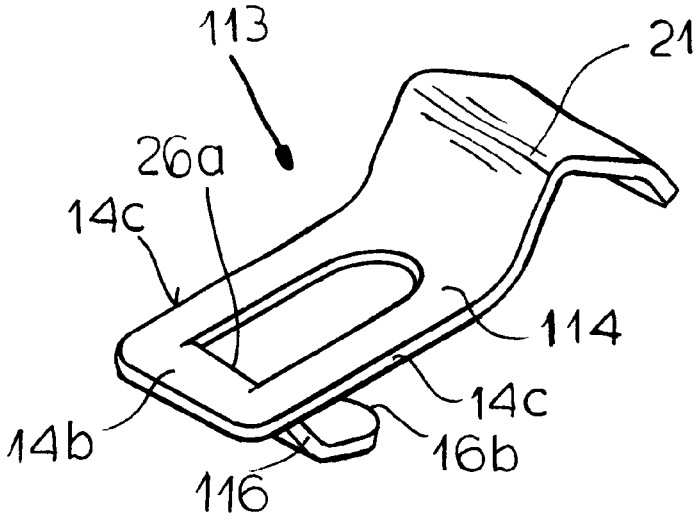
FIG. 7 is a perspective view of the contact spring of FIGS. 4–6.
Figure 5:
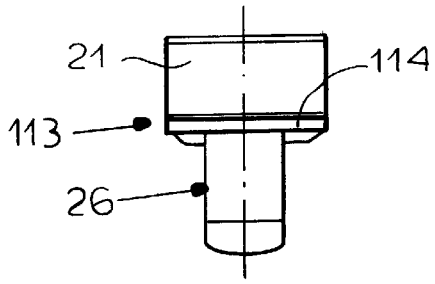
FIG. 5 is a view in the direction of arrow V of the contact spring of FIG. 4.
Figure 6:
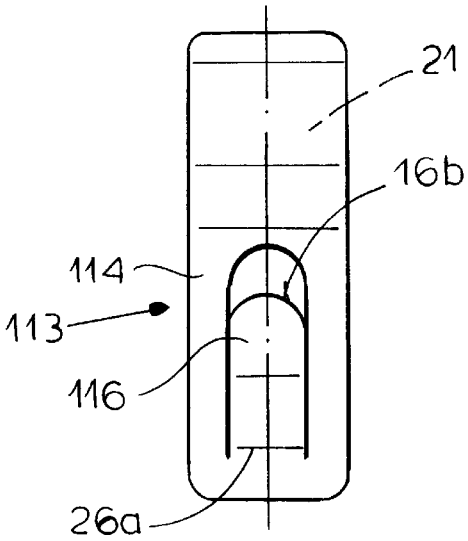
FIG. 6 is a view in the direction of arrow VI of the contact spring of FIG. 4.
Figure 8:
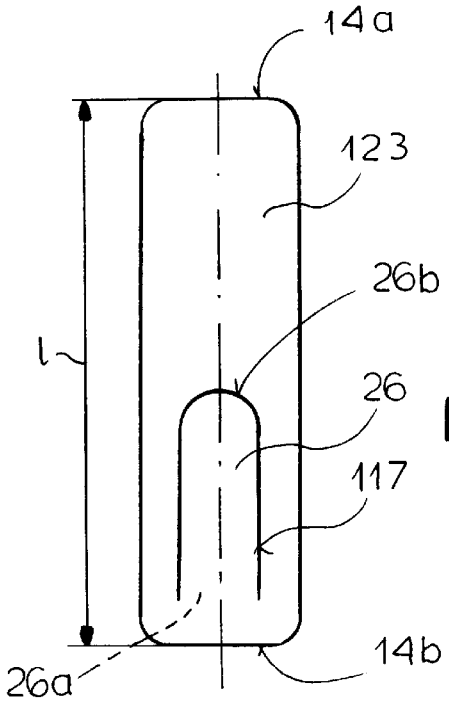
FIG. 8 is a plan view of the sheet metal strip after it has been ensized for the barb but before the retaining shoulder and the barb are pressed into the sheet metal strip.
Figure 9:
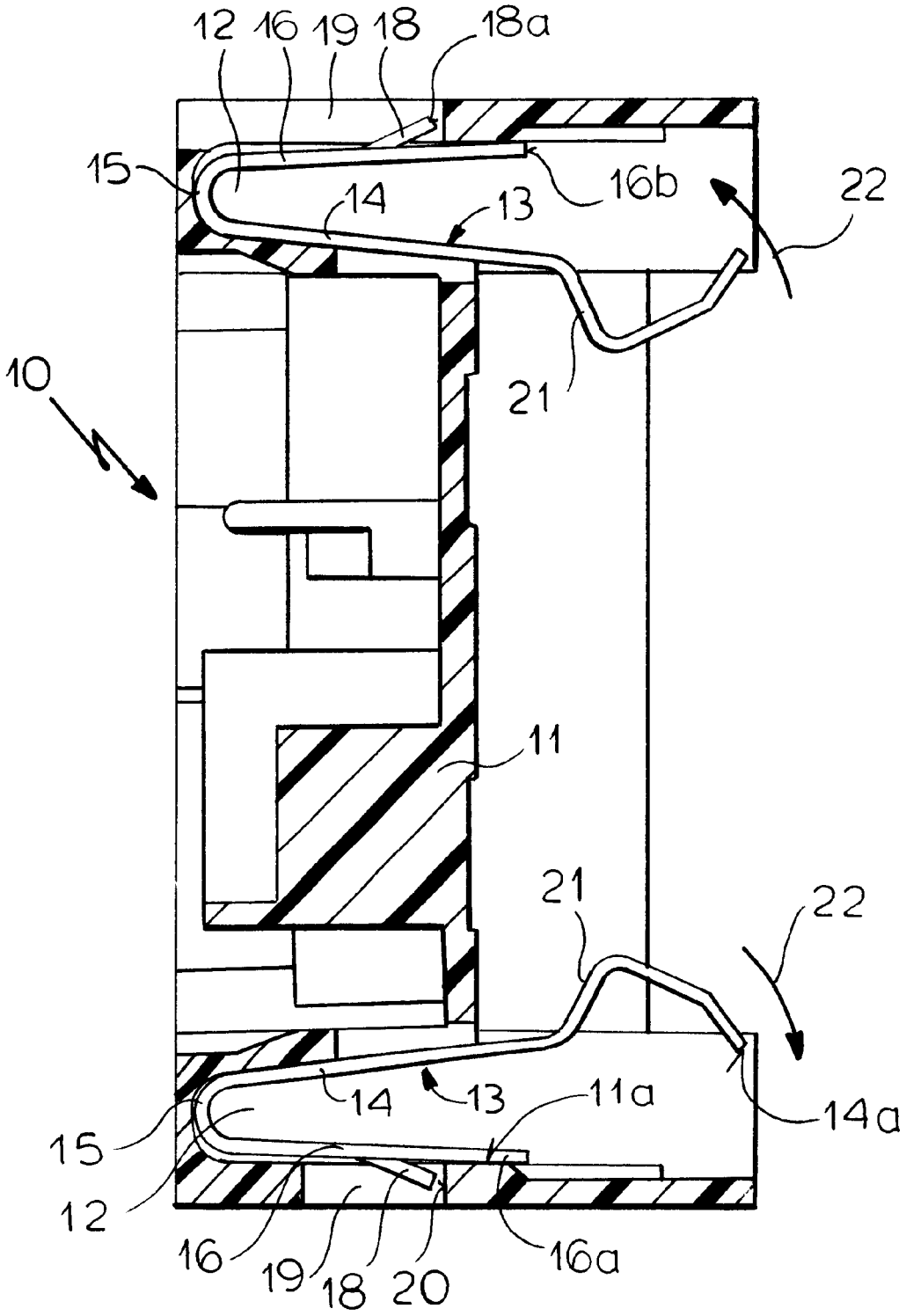
FIG.9 PRIOR ART
FIG. 9 is a view similar to FIG. 1 showing a prior art lamp holder.
Figure 10:
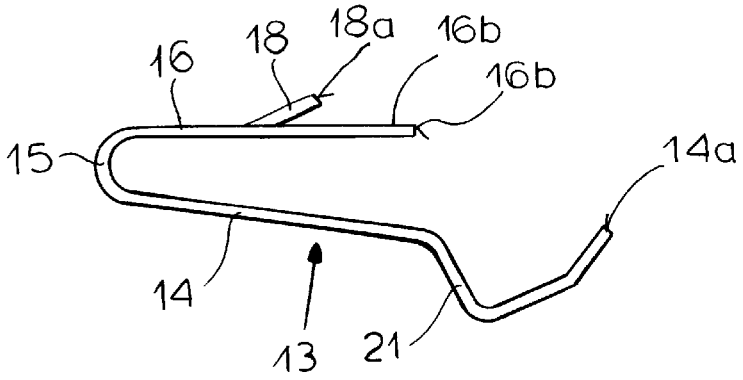
FIG.10 PRIOR ART
FIG. 10 is a view similar to FIG. 4 but showing the contact spring of the prior art holder.
Figure 11:
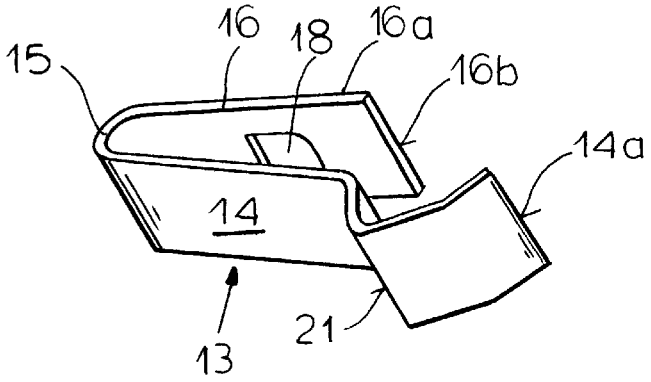
FIG.11 PRIOR ART
FIG. 11 is a perspective view of that contact spring.
Figure 12:
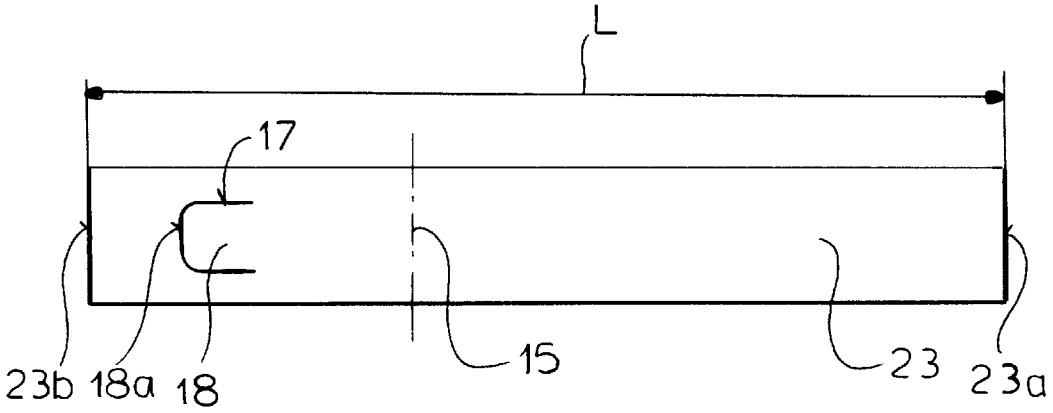
FIG.12 PRIOR ART
FIG. 12 is a view of the sheet metal strip before bending for the contact spring of FIGS. 9–11.

The invention has been illustrated in FIGS. 1–8, and in FIGS. 1–3 a lamp holder 110 with a housing 111 has been shown. A pair of opposite contact springs 113 are provided in pockets 119 of the housing and are differently configured from the contact springs of the prior art embodiment of FIGS. 9–12.

In the system of the invention, the contact springs 113 have retaining shanks 114 which can be provided with shoulders 121 bent outwardly on the planar shank that has been described previously but there the barb and the indexing lug are formed directly on the retaining shank 114 and thus are integrated therewith.

As best seen in FIGS. 5–8, the contact spring 113 has a planar shank 114 from which an elongated spring tongue 26 is bent having been delimited by a U-shaped cut out 117. A connecting portion 26*a* near the end 14*b* of the shank turned away from the end provided with the shoulder 121 connects a straight portion 27 at an acute angle with the shank 114.

The free end of the tongue 26 is arcuate at 26*b* and is turned toward the end provided with the shoulder, namely, the end 14*a* of the sheet metal strip 123.

The tongue 26 is so formed that the straight portion 27 forms an obtuse angle with another portion 116 which here constitutes the bracing member of the contact spring. This configuration is clearly visible from FIGS. 4–7. These Figures also show that the bracing member 116 is integrated in the retaining shank 114 and thus that the contact spring 13 has no bight 15 and no separate bracing shank 16 as have been described. The blank for the contact spring 13 has been shown at 123 in FIG. 8 and has a length 1 which is significantly less than the length L and may be only slightly greater than one-half the length L of the blank 23 of FIG. 12.

From FIGS. 1–3, it will be apparent that the housing 11 can have slits 28 open toward the mouth of the housing to receive the end portion 14*b* of the retaining shank 114. Not shown in FIGS. 1–3 are groove-like guides for laterally guiding the edges 14*c* of the retaining shank 114.

Along the interior of the housing 111, small detent ribs or projections 29 are provided which are engaged by edges 16*b* bracing the legs 116 of the barbs 116, 127 which are pressed out of the cut out 117 of the blanks. The barb has a hole which can be represented at 26 and forms the bracing shank which presses the shank 114 resiliently inwardly. The free edge 16*b* thus fulfills the function of the edge 18*a* of the prior art contact spring.

When the base 25 is inserted in the direction of arrow A, (FIG. 1), the shoulders 21 are cammed outwardly and then snapped behind the ribs 24 on the base 25 (compare FIGS. 2 and 3).

We claim:

1. A lamp holder for a base of a lamp, said lamp holder comprising:

a housing composed of electrically insulating material formed with a cavity opening along a side of said housing; and at least one electrically conductive contact spring received in said housing for engagement with the base of the lamp for mechanical retention of the base and electrical connection therewith, said contact spring being formed from a planar metal strip with a shank having a free end lodged in said housing, a bend at an opposite of the shank and forming a shoulder engageable with and biased against said base for retaining said base in said housing against tension tending to withdraw said base from said housing, and a barb formed from said shank between said free end and said shoulder and bent from said shank out of an opening in said strip, away from a direction in which said shoulder is bent from said shank for bracing against said housing, said barb being formed with a detent lug spaced from said shank and engaging behind a projection on said housing for retaining said contact spring in said housing, said shank being of uniform width and continuous across said width from said opening to said opposite end of said shank, said shank defining a free space with said base and said housing having a wall portion spaced outwardly from said shank and said barb being bent and having a barb portion between said lug and a junction of the barb, with the shank lying along said wall portion and biasing said spring toward said base.

2. The lamp holder defined in claim 1 wherein said shank is substantially straight and flat.

3. The lamp holder defined in claim 2 wherein said barb is elongated and is connected to said shank at an end of said barb turned away from the end of the contact spring provided with said shoulder.

4. The lamp holder defined in claim 2 wherein said barb has a straight portion including an acute angle with said shank.

5. The lamp holder defined in claim 2 wherein said barb has a portion at an obtuse angle to said straight portion and substantially parallel to said shank when said contact spring is held in said housing.

6. The lamp holder defined in claim 2 wherein said barb has a portion which lies flat against said housing and has a curved edge engaging said projection.

7. The lamp holder defined in claim 2 wherein said shank has a portion extending from a junction of said barb with said shank to an end of the shank and received in a slit in said housing.

8. The lamp holder defined in claim 2 wherein said barb is partially cut from said shank and has a free end turned toward an end of the contact spring provided with said shoulder.

9. The lamp holder defined in claim 8 wherein said barb is elongated and is connected to said shank at an end of said barb turned away from the end of the contact spring provided with said shoulder.

10. The lamp holder defined in claim 9 wherein said barb has a straight portion including an acute angle with said shank.

11. The lamp holder defined in claim 10 wherein said barb has another portion at an obtuse angle to said straight portion and substantially parallel to said shank when said contact spring is held in said housing.

12. The lamp holder defined in claim 11 wherein said other portion lies flat against said housing and has an edge engaging said projection.

13. The lamp holder defined in claim 12 wherein said shank has a portion extending from a junction of said straight portion with said shank to an end of the shank and received in a slit in said housing.

* * * * *